US009522562B2

(12) United States Patent
Cho et al.

(10) Patent No.: US 9,522,562 B2
(45) Date of Patent: Dec. 20, 2016

(54) PEN HOLDER

(71) Applicant: SNU R&DB FOUNDATION, Seoul (KR)

(72) Inventors: Kyu Jin Cho, Seoul (KR); Byung Chul Kim, Seoul (KR); Dae Young Lee, Ansan-si (KR)

(73) Assignee: SNU R&DB FOUNDATION, Seoul (KR)

( * ) Notice: Subject to any disclaimer, the term of this patent is extended or adjusted under 35 U.S.C. 154(b) by 0 days.

(21) Appl. No.: 14/651,253

(22) PCT Filed: Feb. 14, 2014

(86) PCT No.: PCT/KR2014/001209
§ 371 (c)(1),
(2) Date: Jun. 11, 2015

(87) PCT Pub. No.: WO2014/137081
PCT Pub. Date: Sep. 12, 2014

(65) Prior Publication Data

US 2015/0328918 A1 Nov. 19, 2015

(30) Foreign Application Priority Data

Mar. 6, 2013 (KR) ..... 10-2013-0023878

(51) Int. Cl.
*A46B 5/04* (2006.01)
*B43K 23/004* (2006.01)
(Continued)

(52) U.S. Cl.
CPC ..... *B43K 23/004* (2013.01); *B43K 23/008* (2013.01); *B43K 23/012* (2013.01); *B43L 15/00* (2013.01)

(58) Field of Classification Search
CPC ... B43K 23/004; B43K 23/008; B43K 23/012; B43L 15/00
(Continued)

(56) References Cited

U.S. PATENT DOCUMENTS 7,794,163 B2 * 9/2010 Bush, III ..... B43K 23/004 15/443
8,146,968 B1 * 4/2012 Starr ..... B43K 23/004 294/25
(Continued)

FOREIGN PATENT DOCUMENTS

AE WO 0198089 A1 * 12/2001 ..... B43K 23/008

OTHER PUBLICATIONS

International Search Report of PCT/KR2014/001209 dated Mar. 14, 2014.

*Primary Examiner* — Jennifer C Chiang
(74) *Attorney, Agent, or Firm* — Lee Patent International

(57) ABSTRACT

The pen holder includes a first, second and third cover portions, a connecting part and a fixing unit. The first, second and third cover portions are respectively inserted into a thumb, a forefinger and a middle finger. The connecting part connects the first, second and third cover portions. A first end of the connecting part is fixed to one of the first, second and third cover portions. A force is applied to a second end of the connecting part such that the first, second and third cover portions are closed to each other. A fixing unit fixes to the second end of the connecting part and applies the force to the connecting part.

13 Claims, 7 Drawing Sheets

(51) Int. Cl.
*B43K 23/008* (2006.01)
*B43L 15/00* (2006.01)
*B43K 23/012* (2006.01)

(58) Field of Classification Search
USPC ..... 401/6–8
See application file for complete search history.

(56) References Cited

U.S. PATENT DOCUMENTS 8,840,157 B2 * 9/2014 Dempsey ..... A46B 5/025
294/25
9,015,866 B2 4/2015 Watanabe
9,205,696 B2 * 12/2015 Young ..... B43K 23/004

* cited by examiner

PEN HOLDER

BACKGROUND

1. Field of Disclosure

The present disclosure of invention relates to a pen holder. More particularly, the present disclosure of invention relates to a pen holder for disabled people having problems in using their fingers.

2. Description of Related Technology

Recently, assistant apparatuses for the disabled or the old are variously developed, and the apparatuses are developed to meet various kinds of purposes of the disabled or the old.

For example, various kinds of pen holders for the disabled having problems in using their fingers have been developed as illustrated in FIG. 1A and FIG. 1B.

Referring to FIG. 1A, the pen holder is fixed to a middle finger and thus is very simple and has good usability. However, different posture for writing is uncomfortable for the disabled, and a pen should be specially designed to be used in the pen holder.

Referring to FIG. 1B, the pen holder is used with similar posture as the non-disabled person, but the pen is not tightly fixed to the hand. In addition, fixing the pen between the fingers is uncomfortable for the disabled.

Accordingly, the pen holder with more convenience should be developed for the disabled or the old.

SUMMARY

The present invention is developed to solve the above-mentioned problems of the related arts. The present invention provides to a pen holder capable of improving the convenience and the portability, with the similar posture as the non-disabled person.

According to an example embodiment, the pen holder includes a first, second and third cover portions, a connecting part and a fixing unit. The first, second and third cover portions are respectively inserted into a thumb, a forefinger and a middle finger. The connecting part connects the first, second and third cover portions. A first end of the connecting part is fixed to one of the first, second and third cover portions. A force is applied to a second end of the connecting part such that the first, second and third cover portions are closed to each other. A fixing unit fixes to the second end of the connecting part and applies the force to the connecting part In an example embodiment, each of the first, second and third covers may include a fabric material.

In an example embodiment, the connecting part may be a relatively thin wire.

In an example embodiment, the first, second and third cover portions closed to each other may be returned to an original position in which the first, second and third cover portions are spaced apart from each other, when the force is not applied to the connecting part.

In an example embodiment, the first cover portion may include a first fixing portion, the second cover portion may include a second fixing portion, and the third cover portion may include third and fourth fixing portions spaced apart from each other and formed on an outer surface of the third cover portion.

In an example embodiment, the first end of the connecting part may be fixed to the fourth fixing portion, and the connecting part may extend passing through the first, second and third fixing portions.

In an example embodiment, the connecting part may extend covering outer surfaces of the first, second and third cover portions, and the second end of the connecting part may extend passing between the first and second cover portions from an inside of the third cover portion.

In an example embodiment, the fixing unit may rotate along a direction to wind the connecting part so as to apply the force.

In an example embodiment, the fixing unit may include a curved path inside thereof through which the connecting part passes through, and apply a frictional force to the connecting part to fix the connecting part.

In an example embodiment, the fixing unit may be fixed on the back of hand.

In an example embodiment, each of the first, second and third cover portions may include an inside cover in which the finger is inserted, an adhesive part fixed to an end of the inside cover, a magnet part fixed to outside of the inside cover, and a cover inside of which the inside cover and the magnet part are disposed.

In an example embodiment, the adhesive part is attached to the magnet part so that the inside cover is fixed to the cover, when the finger is left from each of the first, second and third cover portions.

In an example embodiment, each of the first, second and third cover portions may further include an elastic part disposed inside of the cover and fixed to the magnet part, and a base fixed inside of the cover and fixed to the elastic part.

In an example embodiment, the base may control a height of the elastic part to change a distance between the adhesive part and the magnet part.

According to the example embodiments of the present invention, the pen holder has very simple structure with applying a force to a connecting part in fixed to a thumb, a forefinger and a middle finger, and thus the user may use the pen holder more conveniently.

The pen holder may be held with similar posture as the non-disabled person, and thus an additional or different posture for holding the pen is unnecessary.

In addition, the disabled normally wear half-opened gloves for operating the wheelchair, and thus the pen holder is designed such that the disabled may use the pen holder with only three fingers. Thus, the convenience may be more enhanced.

In addition, fabric type first, second and third covers are worn by three fingers without additional structure for holding the pen, and relatively low force applied to the fabric type covers is necessary to hold the pen. Thus, wearability, movability, durability and convenience may be enhanced.

In addition, the connecting part extends on outer surfaces of the first, second and third covers and receives the force via passing through the first and second covers. Thus, the writing or the holding the pen is prevented from being interfered by the connecting part.

In addition, a fixing unit fixing the connecting part or applying the force to the connecting part is fixed on the back of the hand, and thus the wearability and the convenience may be enhanced.

In addition, each of the first, second and third covers includes an adhesive part and a magnet part, and thus the convenience may be enhanced when the fingers are detached. Further, the height of the magnet part may be changed considering the size of the finger, and thus the convenience may be enhanced.

BRIEF DESCRIPTION OF THE DRAWINGS

The above and other features and advantages will become more apparent by describing exemplary embodiments thereof with reference to the accompanying drawings, in which.

Figure 1A:
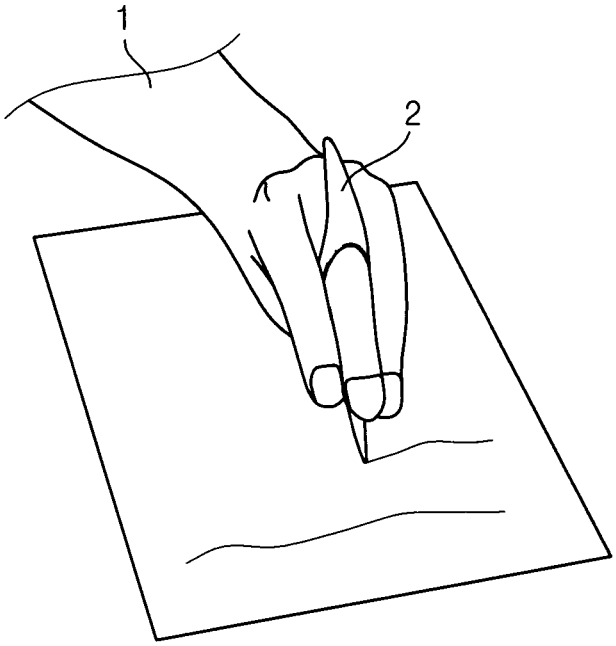
FIG. 1A and FIG. 1B are perspective views illustrating conventional pen holders.
Figure 1B:
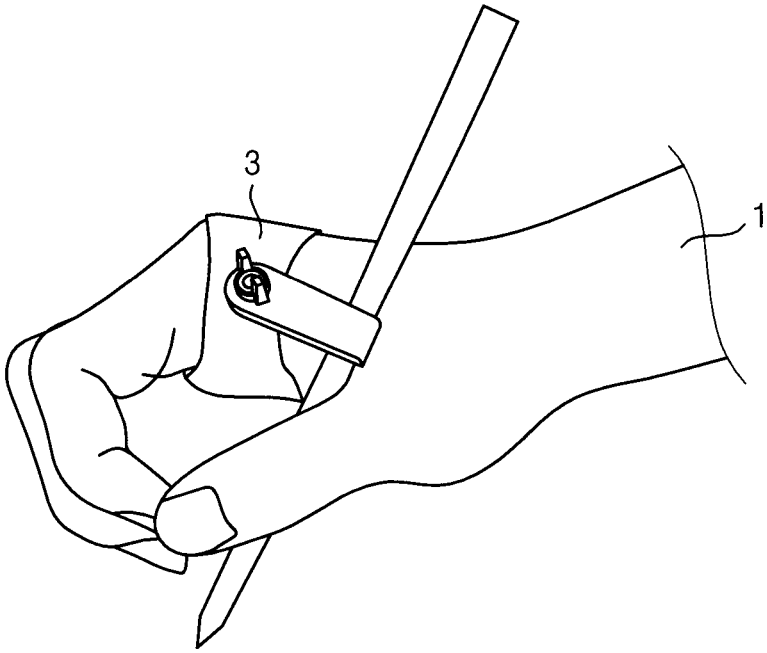

| <Reference numerals> | |
|---|---|
| 5: half-opened glove | 100: penholder |
| 10: first cover portion | 11: first cover |
| 12: first fixing portion | 13: first inside cover |
| 14: first adhesive part | 15: first magnet part |
| 16: first elastic part | 17: first base |
| 20: second cover portion | 30: third cover portion |
| 40: connecting part | 50, 60: fixing unit |

DETAILED DESCRIPTION

It should be understood that the exemplary embodiments of the present invention described below may be varied modified in many different ways without departing from the inventive principles disclosed herein, and the scope of the present invention is therefore not limited to these particular flowing embodiments.

Rather, these embodiments are provided so that this disclosure will be thorough and complete, and will fully convey the concept of the invention to those skilled in the art by way of example and not of limitation.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiment of the invention will be explained in detail with reference to the accompanying drawings.

Figure 2A:
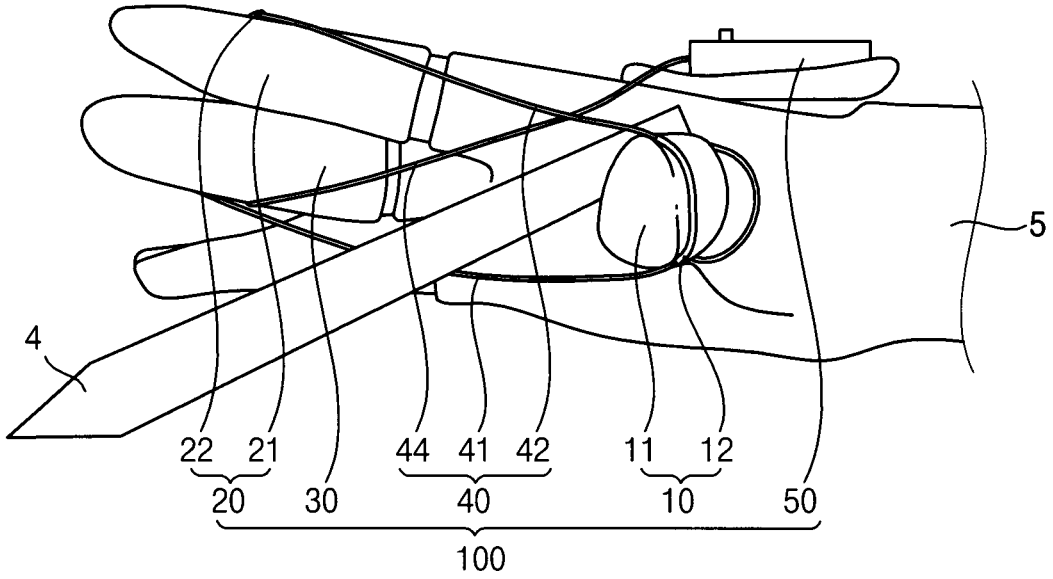
FIG. 2A to FIG. 2C are perspective view illustrating pen holding processes using a pen holder according to the present example embodiment.
Figure 2B:
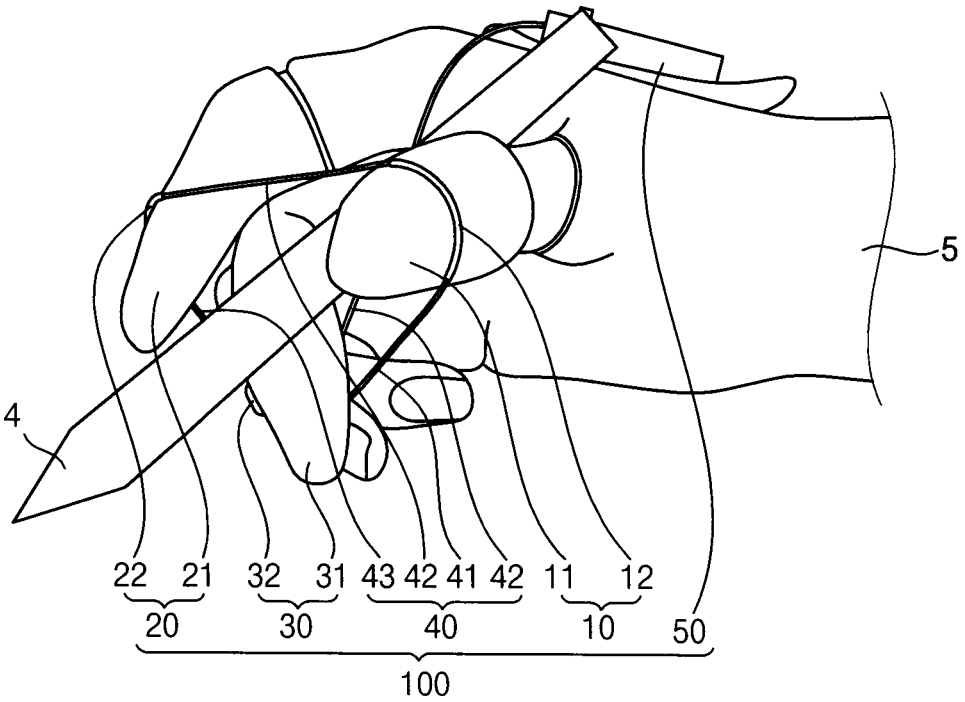
Figure 2C:
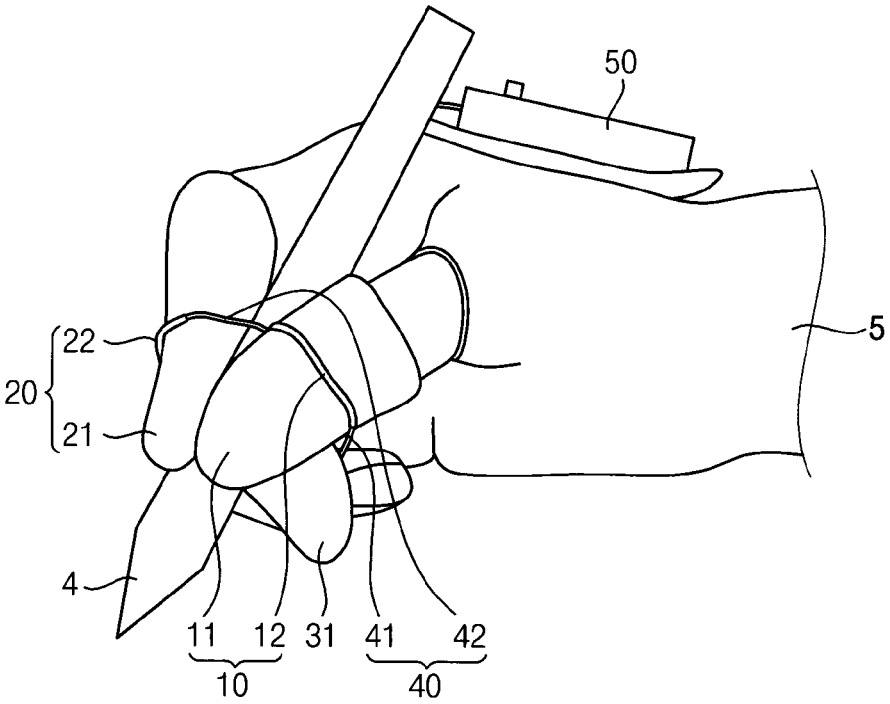
Figure 2D:
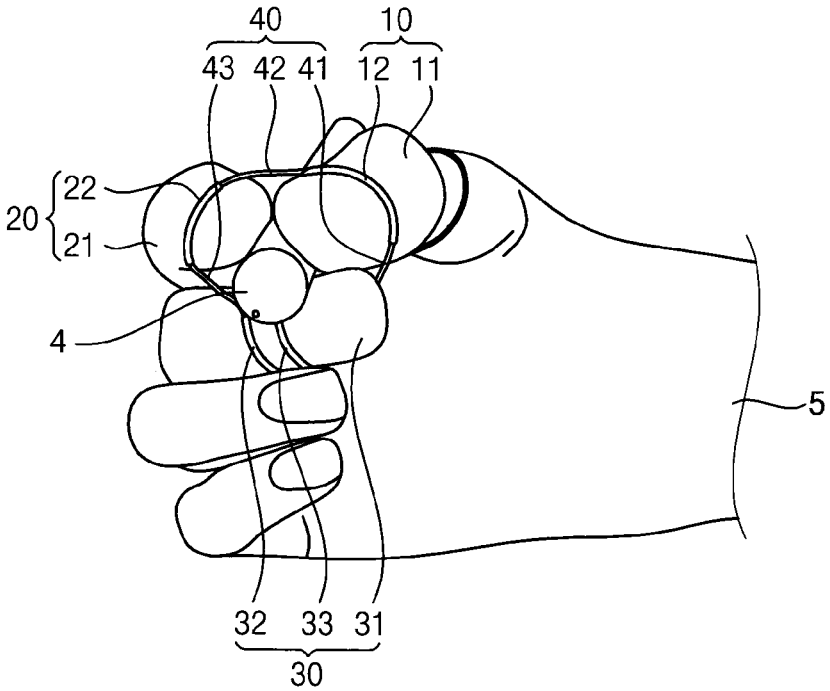
FIG. 2D is a bottom view illustrating a pen holding state using the pen holder in FIG. 2A.

FIG. 2A to FIG. 2C are perspective view illustrating pen holding processes using a pen holder according to the present example embodiment. FIG. 2D is a bottom view illustrating a pen holding state using the pen holder in FIG. 2A.

Referring to FIGS. 2A to 2D, the pen holder 100 according to the present example embodiment includes a first cover portion 10, a second cover portion 20, a third cover portion 30, a connecting part 40 and a fixing unit 50.

Generally, the disabled wear half-opened gloves 5 for operating a wheelchair, and thus the first, second and third cover portions 10, 20 and 30 of the pen holder 100 are respectively inserted into a thumb, a forefinger and a middle finger. Thus, the disabled may additionally wear the pen holder 100 with wearing the half-opened gloves 5.

Alternatively, although not shown in figures, the first, second and third cover portions 10, 20 and 30 of the pen holder 100 may be combined with the half-opened gloves to be a shape of a whole glove covering the palm and the back of the hand, such that the disabled using an automatic wheelchair or the disabled in indoors may easily use the pen holder 100.

For example, the first cover portion 10 includes a first cover 11 and a first fixing portion 12, and a thumb is inserted into the first cover portion 10. The first fixing portion 12 is fixed on an outer surface of the first cover 11. For example, the first fixing portion 12 may be fixed on an outer surface of the first cover 11 making contact with an outer surface of the thumb.

The second cover portion 20 includes a second cover 21 and a second fixing portion 22, and a forefinger is inserted into the second cover portion 20. The second fixing portion 22 is fixed on an outer surface of the second cover 21. For example, the second fixing portion 22 may be fixed on an outer surface of the second cover 21 making contact with an outer surface of the forefinger.

The third cover portion 30 includes a third cover 31, a third fixing portion 32 and a fourth fixing portion 33, and a middle finger is inserted into the third cover portion 30. The third fixing portion 32 and the fourth fixing portion 33 are fixed on an outer surface of the third cover 31. For example, the third and fourth fixing portions 32 and 33 may be fixed on an outer surface of the third cover 31 making contact with an outer surface of the middle finger. In addition, the third and fourth fixing portions 32 and 33 are spaced apart from each other, and the fourth fixing portion 33 is disposed closer to an end of the middle finger than the third fixing portion 32.

The first to third covers 11, 21 and 31 include fabric material, and the fabric material may include materials used for normal gloves. Thus, the wearing sensation may be enhanced.

The first to fourth fixing portions 12, 22, 32 and 33 may fix the connecting part 40 and the connecting part 40 may pass through the first to fourth fixing portions 12, 22, 32 and 33, so that the first to fourth fixing portions 12, 22, 32 and 33 may include the fabric material. The stronger fabric material may be used to increase the durability according to the material of the connecting part 40.

The connecting part 40 includes first, second, third and fourth connecting portions 41, 42, 43 and 44, and the first to fourth connecting portions are connected to each other. The first to fourth connecting portions are divided merely for the convenience of the explanation.

A first end of the first connecting portion 41 is fixed to the fourth fixing portion 33. The first connecting portion 41 extends from the third cover 31 to the first cover 11 and passes through the first fixing portion 12. Here, the first connecting portion 41 extends from an outer surface of the third cover 31 to an outer surface of the first cover 11.

The second connecting portion 42 passes through the first fixing portion 12, extends from the first cover 11 to the second cover 21, and passes through the second fixing portion 22. Here, the second connecting portion 42 extends from an outer surface of the first cover 11 to an outer surface of the second cover 21.

The third connecting portion 43 passes through the second fixing portion 22, extends from the second cover 21 to the third cover 31, and passes through the third fixing portion 32. Here, the third connecting portion 43 extends from an outer surface of the second cover 21 to an outer surface of the third cover 31.

The fourth connecting portion 44 passes through the third fixing portion 32 and extends from the third cover 31 to the fixing unit 50. Here, the fourth connecting portion 44 extends from an outer surface of the third cover 31 to a space between the first and second covers 11 and 21, which is the space between the thumb and the forefinger, through an inside of the third cover 31.

The fixing unit 50 is fixed on a back of the hand, and thus the fourth connecting portion 44 passes through the thumb and the forefinger and extends to the back of the hand.

Accordingly, a first end of the connecting part 40 is fixed to the fourth fixing portion 33, and a second end of the connecting part 40 is fixed to the fixing unit 50 through the first and second covers 11 and 21. For example, the connecting part 40 extends enclosing the thumb, the forefinger and the middle finger, passes between the thumb and the forefinger, and extends to the back of the hand.

The connecting part 40 may be a relatively thin wire, for example, a thread, a string, a rope and so on. Here, a tension is applied to the connecting part 40, and thus the connecting part 40 may include a hard wire capable of the tension.

The fixing unit 50 is fixed on the back of the hand for user's convenience, and the fourth connecting portion 44 is fixed to the fixing unit 50. Alternatively, the fixing position of the fixing unit 50 may be variously changed.

A detailed structure of the fixing unit 50 may be explained below referring to FIGS. 3A and 3B.

Referring to FIGS. 2A to 2C again, generally for the disabled incapable of using the finger, all fingers are positioned as illustrated in FIG. 2A. Thus, the first, second and third cover portions 10, 20 and 30 are respectively inserted into the thumb, the forefinger and the middle finger among the fingers.

Then, the force, for example the tension is applied to the fourth connecting portion 44 extending between the thumb and the forefinger, and then the fourth connecting portion 44 is pulled between the first and second covers 10 and 20. Then, the third, second and first connecting portions 43, 42 and 41 which are connected to the fourth connecting portion 44 are respectively pulled, and as the third, second and first connecting portions 43, 42 and 41 are pulled, as illustrated in FIGS. 2A to 2C, the first, second and third cover portions 10, 20 and 30 are closed to each other. Thus, ends of the thumb, the forefinger and the middle finger are closed to each other, and then the pen may be grasped by the fingers.

Then, as the fourth connecting portion 44 is fixed to the fixing unit 50 with the applied tension, the position of the fingers as illustrated in FIG. 2C are maintained and thus the user may write with the pen as grasped by the finger.

However, as the fourth connecting portion 44 is released from the fixing unit 50 as the applied tension is reduced, the position of the fingers are returned to the positions as illustrated in FIG. 2A, and thus the user may stop writing.

Figure 3A:
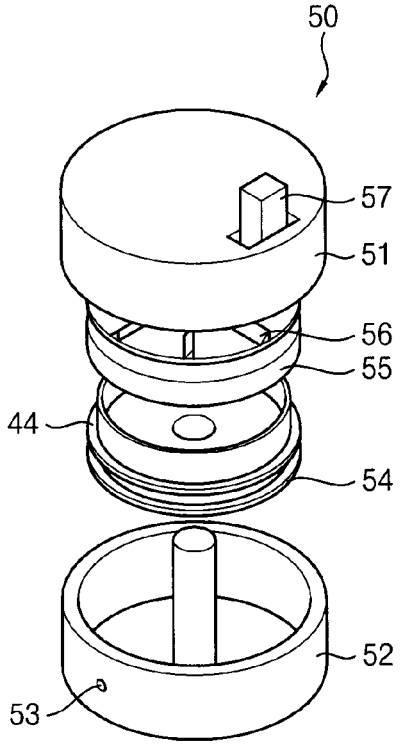
FIG. 3A is an exploded perspective view illustrating an example fixing unit of the pen holder in FIG. 2A.

FIG. 3A is an exploded perspective view illustrating an example fixing unit of the pen holder in FIG. 2A.

Referring to FIG. 3A, the fixing part 50 includes an upper cover 51, a lower cover 52, a rotation part 55 and an inner unit 54. The rotation part 55 and the inner unit 54 are disposed between the upper and lower covers 51 and 52. The rotation part 55 includes a protrusion 56, and the fourth connecting portion 44 is winded to the inner unit 54. The fourth connecting portion 44 passes through an opening 53 of the lower cover 52.

A button 57 is formed through the upper cover 51, and fixes the rotating part 55 through the protrusion 56. Thus, the fourth connecting portion 44 may be fixed at a position. Here, the button 57 is pushed to be released with the rotating part 55, and then the tension applied to the fourth connecting portion 44 is decreased and the fourth connecting portion 44 is released.

Accordingly, the fixing unit 50 may be a ratchet structure. For example, the inner unit 54 rotates in a direction to wind and fix the fourth connecting portion 44, and when the button 57 is pushed, the inner unit 54 rotates in an opposite direction to release the fourth connecting portion 44.

Figure 3B:
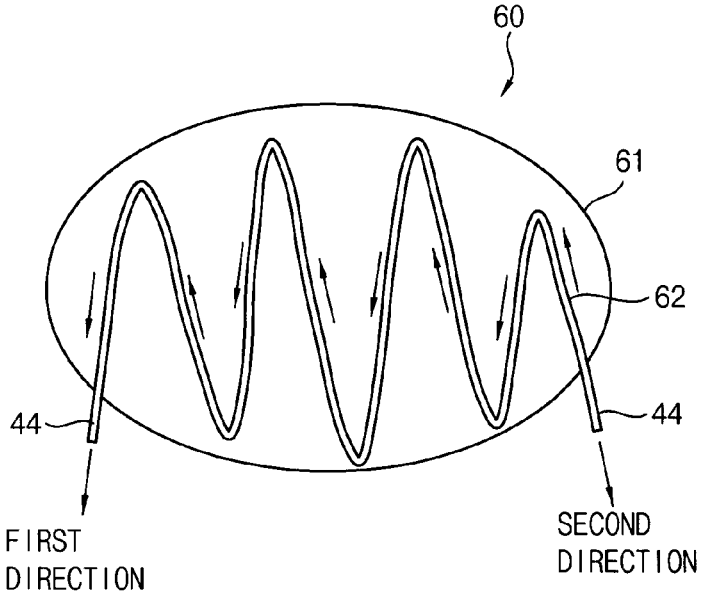
FIG. 3B is a cross-sectional view illustrating another example fixing unit of the pen holder in FIG. 2A.

FIG. 3B is a cross-sectional view illustrating another example fixing unit of the pen holder in FIG. 2A.

Referring to FIG. 3B, the fixing unit 60 includes an outer cover 61 and a pathway 62.

The fourth connecting part 44 passes through the pathway 62. As illustrated in figure, the pathway 62 has a zigzag shape, so that a frictional force may be applied to the fourth connecting portion 44.

Thus, the fourth connecting portion 44 may be fixed via the frictional force of the pathway 62, and the fourth connecting portion 44 may move as a force larger than the frictional force is applied.

Here, when the force larger than the frictional force of the pathway 62 is applied along a first direction, the tension is applied to the fourth connecting portion 44 and then the first, second and third cover portions 10, 20 and 30 are closed to each other and the pen is fixed as illustrated in FIG. 2C.

However, when the force larger than the frictional force of the pathway 62 is applied along a second direction, the fourth connecting portion 44 is released and then the first, second and third cover portions 10, 20 and 30 are spaced apart from each other and are positioned as illustrated in FIG. 2A.

Figure 4:
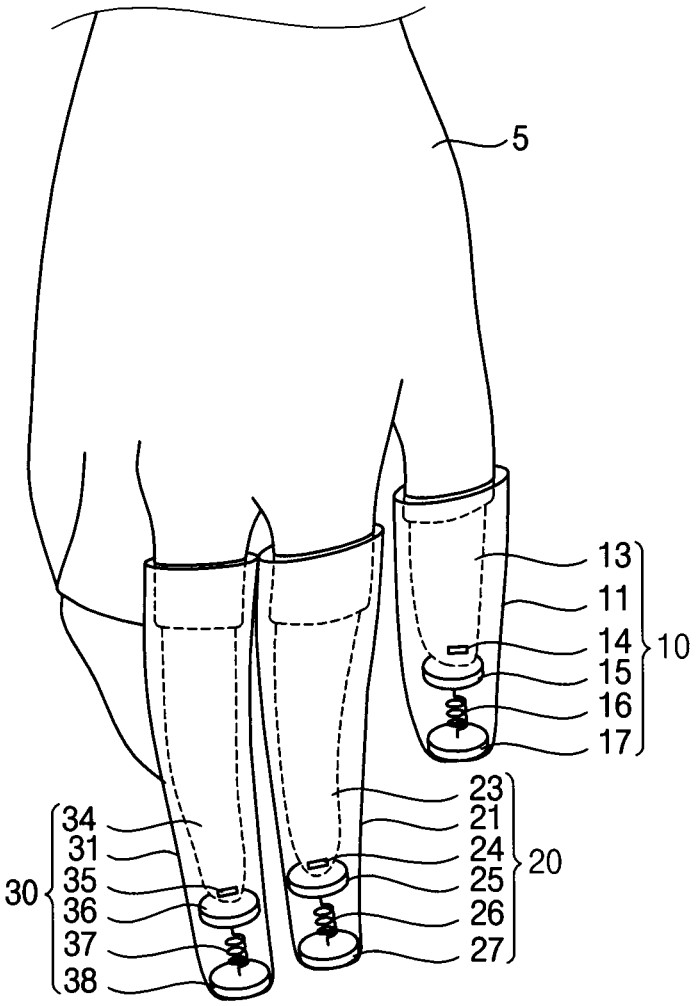
FIG. 4 is a perspective view illustrating an inside of the pen holder in FIG. 2A.

FIG. 4 is a perspective view illustrating an inside of the pen holder in FIG. 2A.

Referring to FIG. 4, as explained above, the disabled normally wears the half-opened gloves 5 for operating the wheelchair, and thus in the pen holder 100 according to the present example embodiment, the first, second and third cover portions 10, 20 and 30 are respectively inserted into the thumb, the forefinger and the middle finger.

Each of the first, second and third cover portions 10, 20 and 30 is substantially same with each other, and thus hereinafter, the first cover portion 10 is explained, and a repetitive explanation will be omitted.

The first cover portion 10 includes the first cover 11 and the first fixing portion 12, and further includes a first inner cover 13, a first adhesive part 14, a first magnet part 15, a first elastic part 16 and a first base 17.

The thumb is inserted into the first inner cover 13, and the first inner cover 13 is formed inside of the first cover 11.

The first adhesive part 14 is fixed to an end of the first inner cover 13, and the first adhesive part 14 includes a metal material. Thus, the first adhesive part 14 may be attached to the first magnet part 15.

The first magnet part 15, the first elastic part 16 and the first base 17 are fixed between the first inner cover 13 and the first cover 11, and the first base 17 is fixed to an inside end of the first cover 17. The first magnet part 15 is fixed to an end of the first elastic part 16, and the first elastic part 16 is fixed to the first base 17. The first elastic part 16 provides an elastic force to the first magnet part 15, and a position of the first magnet part 15 is changed according to the elastic force applied to the first magnet part 15.

For example, as the thumb is longer, the first inner cover 13 may be closer to the first magnet part 15. Further, as the thumb is much longer, the first magnet part 15 may be much closer to the first base 17 with the first magnet part 15 attached to the first adhesive part 14. Here, the elastic force of the first elastic part 16 is maintained such that the first magnet part 15 is prevented from being too close to the first base 17, and then the position of the thumb may be properly maintained.

Likewise, the second cover portion 20 includes the second cover 21 and the second fixing portion 22, and further includes a second inner cover 23, a second adhesive part 24, a second magnet part 25, a second elastic part 26 and a second base 27.

In addition, the third cover portion 30 includes the third cover 31, the third fixing portion 32 and the fourth fixing portion 33, and further includes a third inner cover 34, a third adhesive part 35, a third magnet part 36, a third elastic part 37 and a third base 38.

The structure, shape and functions of the elements of the second and third cover portions 20 and 30 are substantially same as those of the first cover portion 10, and thus any repetitive explanation will be omitted.

Figure 5A:
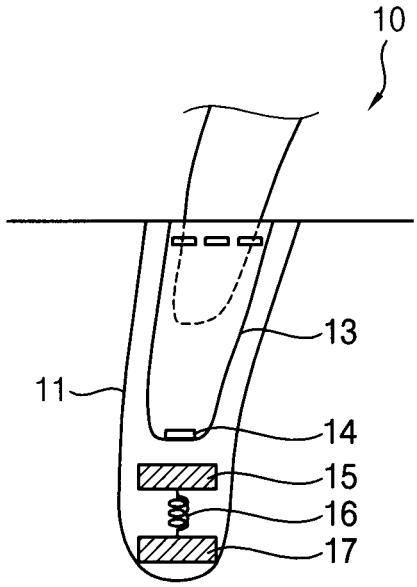
FIG. 5A and FIG. 5B are schematic views illustrating the inside of the pen holder when the finger is attached in FIG. 2A.
Figure 5B:
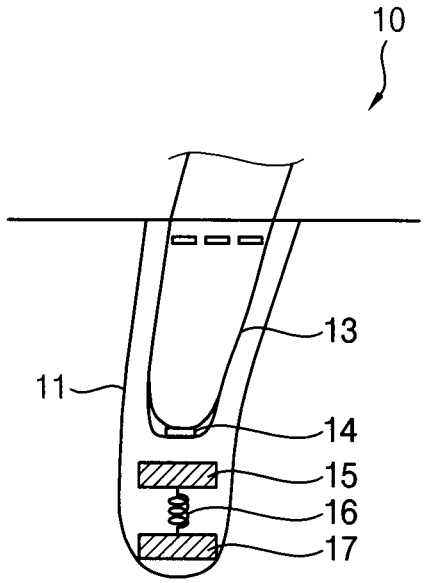

FIG. 5A and FIG. 5B are schematic views illustrating the inside of the pen holder when the finger is attached in FIG. 2A.

Referring to FIGS. 5A and 5B, when the thumb (the forefinger and the middle finger are substantially same) is inserted into the first inner cover 13, the first adhesive part 14 is attached to or spaced apart from the first magnet part 15 as the length of the thumb.

The user may use the pen 4 with the pen holder 100, whether or not the first adhesive part 14 is attached to the first magnet part 15.

Figure 6A:
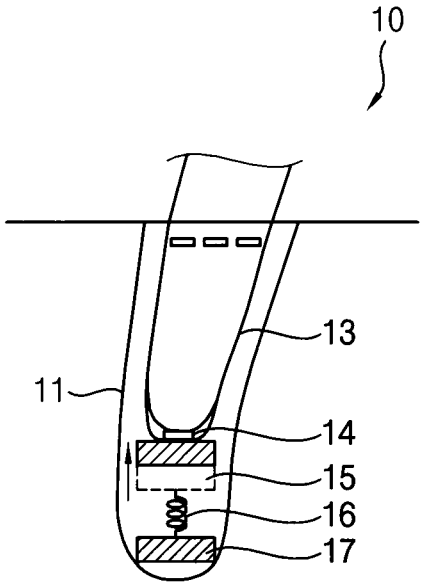
FIG. 6A and FIG. 6B are schematic views illustrating the inside of the pen holder when the finger is detached in FIG. 2A.
Figure 6B:
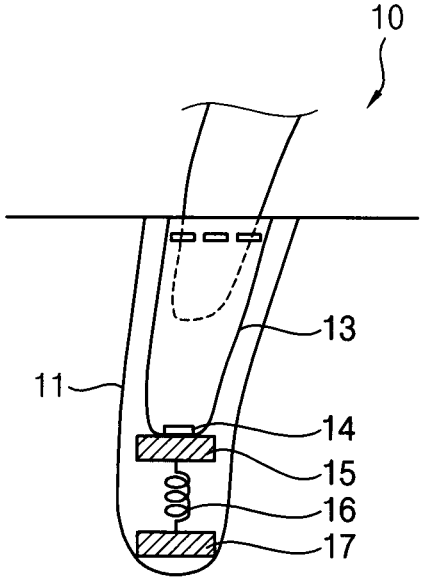

FIG. 6A and FIG. 6B are schematic views illustrating the inside of the pen holder when the finger is detached in FIG. 2A.

Generally, when the user stops using the pen holder 100 and the finger is detached from the pen holder 100, to pull out the thumb from the inner cover 13 may be very difficult for the disabled.

Referring to FIGS. 6A and 6B, when the user stops using the pen holder 100, the first elastic part 16 fixed to the first base 17 rises up and the first magnet part 15 fixed to the first elastic part 16 rises up too. Here, the first base 17 may include a driving part like a motor and thus raise the first elastic part 16.

As the first magnet part 15 rises up, the first magnet part 15 is attached to the first adhesive part 14, and then the first inner cover 13 to which the first adhesive part 14 is attached is fixed to the first cover 11.

Thus, even though the thumb is pulled out from the first inner cover 13, the first inner cover 13 is not pulled out with the thumb and is maintained with attached to the first cover 11. Thus, the pulling out of the thumb may be more easily, and the convenience may be more enhanced.

Likewise, although not shown in figures, when the forefinger and the middle finger are pulled out from the second and third inner covers 23 and 34 respectively, the second and third inner covers 23 and 34 are not pulled out and are maintained with attached to the second and third covers 21 and 31, and thus the convenience may be more enhanced.

According to the example embodiments of the present invention, the pen holder has very simple structure with applying a force to a connecting part in fixed to a thumb, a forefinger and a middle finger, and thus the user may use the pen holder more conveniently.

The pen holder may be held with similar posture as the non-disabled person, and thus an additional or different posture for holding the pen is unnecessary.

In addition, the disabled normally wear half-opened gloves for operating the wheelchair, and thus the pen holder is designed such that the disabled may use the pen holder with only three fingers. Thus, the convenience may be more enhanced.

In addition, fabric type first, second and third covers are worn by three fingers without additional structure for holding the pen, and relatively low force applied to the fabric type covers is necessary to hold the pen. Thus, wearability, movability, durability and convenience may be enhanced.

In addition, the connecting part extends on outer surfaces of the first, second and third covers and receives the force via passing through the first and second covers. Thus, the writing or the holding the pen is prevented from being interfered by the connecting part.

In addition, a fixing unit fixing the connecting part or applying the force to the connecting part is fixed on the back of the hand, and thus the wearability and the convenience may be enhanced.

In addition, each of the first, second and third covers includes an adhesive part and a magnet part, and thus the convenience may be enhanced when the fingers are detached. Further, the height of the magnet part may be changed considering the size of the finger, and thus the convenience may be enhanced.

The pen holder according to the present example embodiment may be used for the disabled, the old and so on to write using the pen.

What is claimed is:

1. The pen holder comprising:

first, second and third cover portions respectively inserted into a thumb, a forefinger and a middle finger;

a connecting part connecting the first, second and third cover portions, a first end of the connecting part being fixed to one of the first, second and third cover portions, a force being applied to a second end of the connecting part such that the first, second and third cover portions are closed to each other; and a fixing unit fixing to the second end of the connecting part and applying the force to the connecting part, wherein the first, second and third cover portions closed to each other are returned to an original position in which the first, second and third cover portions are spaced apart from each other, when the force is not applied to the connecting part.

2. The pen holder of claim 1, wherein each of the first, second and third covers comprises a fabric material.

3. The pen holder of claim 2, wherein the connecting part is a relatively thin wire.

4. The pen holder of claim 1, wherein the first cover portion comprises a first fixing portion, the second cover portion comprises a second fixing portion, and the third cover portion comprises third and fourth fixing portions spaced apart from each other and formed on an outer surface of the third cover portion.

5. The pen holder of claim 4, wherein the first end of the connecting part is fixed to the fourth fixing portion, and the connecting part extends passing through the first, second and third fixing portions.

6. The pen holder of claim 5, wherein the connecting part extends covering outer surfaces of the first, second and third cover portions, and the second end of the connecting part extends passing between the first and second cover portions from an inside of the third cover portion.

7. The pen holder of claim 1, wherein the fixing unit rotates along a direction to wind the connecting part so as to apply the force.

8. The pen holder of claim 1, wherein the fixing unit comprises a curved path inside thereof through which the connecting part passes through, and applies a frictional force to the connecting part to fix the connecting part.

9. The pen holder of claim 1, wherein the fixing unit is fixed on the back of hand.

10. The pen holder of claim 1, wherein each of the first, second and third cover portions comprises:

an inside cover in which the finger is inserted;

an adhesive part fixed to an end of the inside cover;

a magnet part fixed to outside of the inside cover; and a cover inside of which the inside cover and the magnet part are disposed.

11. The pen holder of claim 10, wherein the adhesive part is attached to the magnet part so that the inside cover is fixed to the cover, when the finger is left from each of the first, second and third cover portions.

12. The pen holder of claim 10, wherein each of the first, second and third cover portions further comprises:

an elastic part disposed inside of the cover and fixed to the magnet part; and a base fixed inside of the cover and fixed to the elastic part.

13. The pen holder of claim 12, wherein the base controls a height of the elastic part to change a distance between the adhesive part and the magnet part.

* * * * *